United States Patent [19]

Nitta

[11] 4,190,412

[45] Feb. 26, 1980

[54] DISPOSABLE CIGARETTE GAS LIGHTER WITH SNUFFING COVER

[75] Inventor: Tomio Nitta, Yokohama, Japan

[73] Assignee: Tokai Seiki Co., Ltd., Yokohama, Japan

[21] Appl. No.: 863,436

[22] Filed: Dec. 22, 1977

[30] Foreign Application Priority Data

Dec. 28, 1976 [JP] Japan ..... 51/158519
Dec. 28, 1976 [JP] Japan ..... 51/175768[U]

[51] Int. Cl.[2] ..... F23Q 25/00
[52] U.S. Cl. ..... 431/151; 431/152
[58] Field of Search ..... 431/151, 152, 130, 131, 431/150, 142, 143

[56] References Cited

U.S. PATENT DOCUMENTS 3,414,364 12/1968 Bert ..... 431/143
3,895,903 7/1975 Lefebvre ..... 431/143

FOREIGN PATENT DOCUMENTS 801664 1/1951 Fed. Rep. of Germany ..... 431/143
565574 11/1944 United Kingdom ..... 431/143

*Primary Examiner*—Carroll B. Dority, Jr.
*Assistant Examiner*—Lee E. Barrett
*Attorney, Agent, or Firm*—Harold L. Stults

[57] ABSTRACT

A disposable cigarette gas lighter has a snuffing cover on a plastic fuel reservoir. The snuffing cover is rotatably mounted on the lighter independently of a sparking wheel. When lighting the lighter, the snuffing cover is opened with the thumb which is used for rotating the sparking wheel so that the snuffing cover will be opened when the sparking wheel is rotated. When closing the snuffing cover, the snuffing cover is closed independently of the sparking wheel. Further, the snuffing cover can be opened without rotating the sparking wheel so that the sparking wheel is not rotated when the snuffing cover is accidentally opened.

6 Claims, 11 Drawing Figures

DISPOSABLE CIGARETTE GAS LIGHTER WITH SNUFFING COVER

BACKGROUND OF THE INVENTION

1. Field of the Invention

This invention relates to a disposable cigarette gas lighter, and more particularly to a disposable cigarette gas lighter provided with a snuffing cover.

2. Description of the Prior Art

A disposable cigarette gas lighter (hereinafter referred to simply as a "disposable lighter" or "lighter") comprising a plastic fuel reservoir for retaining therein liquified inflammable fluid and an operative lighter assembly mounted on the reservoir is well known and widely used. The lighter assembly includes a flint holding means for holding a flint element, a sparking wheel, a spring element provided in the flint holding means for biasing the flint element onto the sparking wheel, a shaft for rotatably mounting the sparking wheel, a fluid nozzle for connecting the interior of the reservoir with the ambient air, a shut-off valve incorporated in the fluid nozzle, and a valve opening lever for opening the shut-off valve which is spring biased in the direction to close the valve and opens the valve when depressed against the force of the biasing spring.

This kind of disposable lighter is very cheap and convenient to carry, and accordingly, enjoys wide popularity and is replacing matches. However, since the lighter assembly is exposed, it is necessary and important to give careful consideration to safety. When the valve is not completely closed, there remains on the nozzle an extremely small flame which may ignite fluff or other inflammable material in the pocket. Such a fire may spread to the pocket material and other parts of the clothing.

In order to eliminate this danger, it is possible to improve the precision of the shut-off valve. This will, however, raise the cost of the lighter and undesirably detract from the foremost advantage of the disposable lighter—its cheapness.

On the other hand, since the disposable lighter is often carried in the pocket, it must be made safe from being easily lit in the pocket by accident. The conventional disposable lighter as described hereinbefore is lit by two actions, namely by rotating the sparking wheel and depressing the valve opening lever. Though it is very rare for a disposable lighter to be lit accidentally in the pocket, such an accident is indeed possible especially when the user is engaged in some rough physical activity as when playing a sport. One solution to this problem is to provide a snuffing cover on the lighter and bias the cover in its closed position. The problem in doing this, however, is that the snuffing cover must be easy to open to facilitate lighting but not so easily opened as to defeat the purpose for which it was provided.

It is known in the art to provide a snuffing cover on a disposable lighter. In the known lighter provided with a snuffing cover, the snuffing cover is usually combined with the sparking wheel so that the sparking wheel is rotated together with the snuffing cover in order to facilitate the operation of the lighter. Such a lighter, however, is disadvantageous in that the sparking wheel is rotated together with the snuffing cover even when the snuffing cover is opened accidentally in a pocket. Thus, any accidental opening of the snuffing cover as when the user is engaged in an active sport may cause accidental burning of the pocket. If, on the other hand, the operation of the snuffing cover is made completely independent of the rotation of the sparking wheel, the action to light becomes more complex and less prone to accidental lighting.

SUMMARY OF THE INVENTION

It is, therefore, the primary object of the present invention to provide a disposable cigarette gas lighter which has a snuffing cover and is easy to light but has little susceptibility to accidental lighting.

Another object of the present invention is to provide a disposable lighter provided with a snuffing cover in which the snuffing cover is opened simultaneously with the rotation of the sparking wheel.

Still another object of the present invention is to provide a disposable lighter provided with a snuffing cover in which the sparking wheel is not automatically rotated when the snuffing cover is rotated.

The disposable lighter in accordance with the present invention is characterized in that a snuffing cover is mounted on a plastic fuel reservoir wherein the snuffing cover is opened when the sparking wheel is rotated with the thumb but the sparking wheel is not rotated automatically when the snuffing cover is accidentally opened. Further, the snuffing cover of the lighter of this invention is easily opened when the lighter is to be operated to light. The snuffing cover may be spring biased to its closed position or snap held in its closed position.

The snuffing cover provided on the lighter of this invention has openings for exposing a part of the sparking wheel so that the sparking wheel may be rotated by the thumb. The snuffing cover is further provided with a finger engaging portion at a position to receive the thumb when the thumb is used for rotating the sparking wheel so that the snuffing cover is rotated into its open position when the sparking wheel is rotated by the thumb. When closing the snuffing cover, the snuffing cover is closed independently of the sparking wheel. In the disposable lighter in accordance with the present invention, the valve opening lever is operable independently of the snuffing cover and the sparking wheel. Therefore, the likelihood of accidental lighting of the lighter is almost nil.

It should be noted that the lighter provided with a snuffing cover in accordance with the present invention is different from the conventional metal gas lighter with a cover. The structure of the conventional metal gas lighter having a cover is such that the cover is connected with a valve opening lever. Therefore, the operation of the cover and that of the valve opening lever are made by one action. This is undesirable from the viewpoint of prevention of accidental burning of pockets. With such a structure, if the sparking wheel is accidentally rotated in the pocket while the cover is open and the valve is open, there is a possibility of explosion. In the lighter of this invention, there is no such possibility because the snuffing cover is independent of the valve opening lever.

DESCRIPTION OF THE PREFERRED EMBODIMENTS

Figure 1:
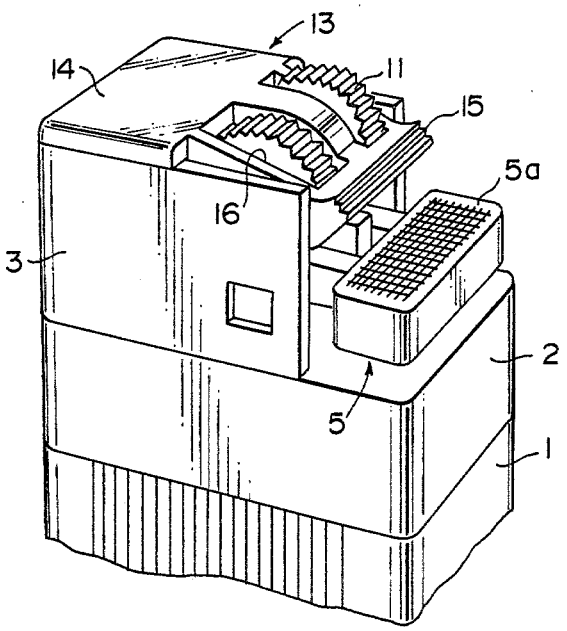
FIG. 1 is a fragmentary perspective view showing an embodiment of the disposable lighter in accordance with the present invention.

Referring to FIG. 1, on a plastic fuel reservoir 1 is mounted a casing 2 on which a metal windbreak wall 3 is fixed. The casing 2 is provided with an operative lighter assembly as shown in FIG. 2 in detail.

Figure 2:
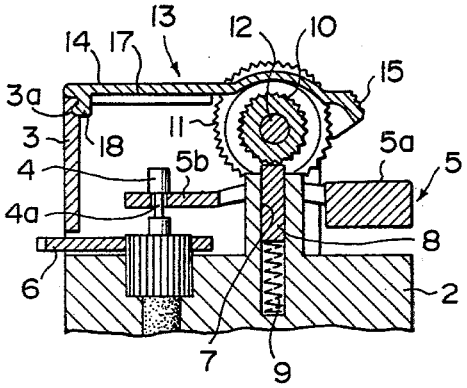
FIG. 2 is a fragmentary vertical sectional view showing the internal structure of the embodiment of the lighter as shown in FIG. 1.

Referring to FIG. 2, a fluid nozzle 4 is provided on the casing 2 surrounded by the windbreak wall 3. The nozzle 4 has a neck portion 4*a* with which a fork-shaped end 5*b* of a valve opening lever 5 is engaged. The valve opening lever 5 has at the other end a finger engaging portion 5*a* and is swingable in a vertical plane about a fulcrum at an intermediate portion thereof. The valve opening lever 5 is spring biased by the neck portion 4*a* of the nozzle 4 in the direction to close the valve. By depressing the finger engaging portion 5*a* of the lever 5, the fork-shaped end 5*b* thereof is raised to lift the nozzle neck 4*a* to open the valve of the nozzle 4 and let a fuel gas spout from the nozzle 4. The rate at which the gas is spouted is controlled by a control lever 6 connected with the valve of the nozzle 4. By releasing the finger engaging portion 5*a*, the valve opening lever 5 is swung back to its original position to close the valve of the nozzle 4.

A flint element 8 is held in a flint holding hole 7 and is spring-biased upward by means of a compression spring 9. Above the flint holding hole 7 is rotatably supported a sparking wheel 10. The sparking wheel 10 has on either side thereof one of a pair of knurled wheels 11 having a diameter larger than the diameter of the sparking wheel 10. The sparking wheel 10 and the knurled wheels 11 fixed thereto are rotatably supported on a shaft 12. In the lighting operation, the knurled wheels 11 are rotated by the thumb clockwise in FIG. 2 to rotate the sparking wheel 10 in the same direction to rub the top end of the flint element 8.

The windbreak wall 3 has an open top end through which the flame rises. In order to close the open end of the windbreak wall 3 and prevent accidental lighting, a snuffing cover 13 is provided. FIGS. 4 to 9 show in detail one example of the snuffing cover 13. The snuffing cover 13 has a covering portion 14 which closes the open upper end of the metal windbreak wall 3, a finger engaging portion 15 with which a finger or the thumb of the user engages when lighting and a pair of slots 16 extending between the covering portion 14 and the finger engaging portion 15 through which the pair of knurled wheels 11 are exposed. Beneath the covering portion 14 of the cover 13 is integrally fixed a U-shaped protrusion 17 which is to be mated with the upper edge of the windbreak wall 3. A snap-in projection 18 is integrally formed on a part of the protrusion 17 so that the projection 18 is engaged with an engaging groove 3*a* of the windbreak wall 3 when the cover 13 is closed as shown in FIG. 2. The projection 18 is simply snapped in into the engaging groove 3*a* of the wall 3 to hold the cover 13 in the closed position.

One of a pair of lugs 19 is provided on the outside of each of the pair of slots 16. Each lug 19 has at the lower end thereof bearing slots 20. The bearing slots 20 are rotatably engaged with the shaft 12 of the sparking wheel 10 and hold the snuffing cover 13 rotatably on the shaft 12 so that the cover 13 may be moved between a closed position to close the open end of the windbreak wall 3 and an open position to open the same. The snuffing cover 13 is further provided with a bridge portion 21 extending over the sparking wheel 10 between the slots 16. The snuffing cover 13 is snapped in on the shaft 12 after all other elements of the lighter are assembled.

Figure 3:
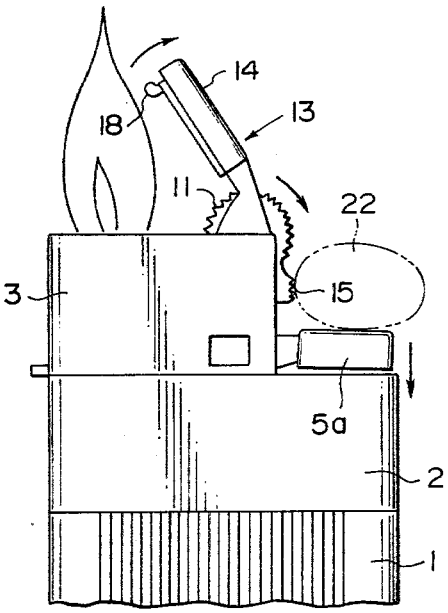
FIG. 3 is a fragmentary side view of the lighter as shown in FIGS. 1 and 2 in which the snuffing cover is opened and the valve opening lever is depressed.
Figure 4:
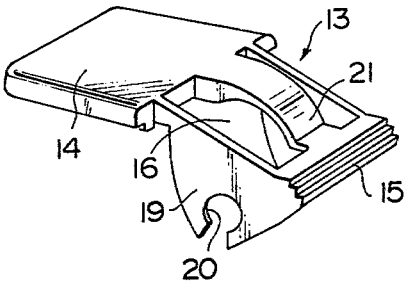
FIG. 4 is a perspective view of an example of a snuffing cover employed in this invention.
Figure 7:
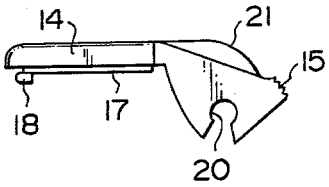
FIG. 7 is a side view of the snuffing cover as shown in FIGS. 4 to 6.
Figure 5:
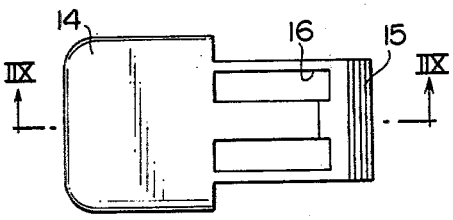
FIG. 5 is a plan view of the snuffing cover as shown in FIG. 4.
Figure 8:
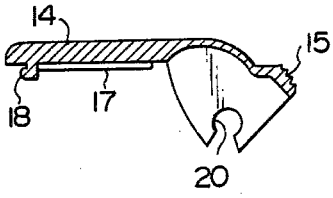
FIG. 8 is a side sectional view of the snuffing cover as shown in FIGS. 4 to 7 taken along the line IIX—IIX of FIG. 5.
Figure 6:
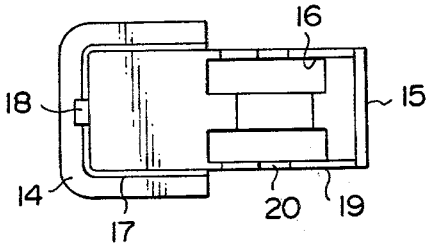
FIG. 6 is a bottom view of the snuffing cover as shown in FIGS. 4 and 5.
Figure 9:
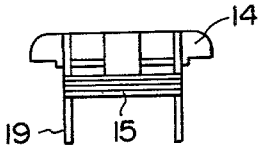
FIG. 9 is a front view of the snuffing cover as shown in FIGS. 4 to 8.

In operation, when lighting the lighter, the sparking wheel 10 is rotated by rotating the knurled wheels 11 with the thumb 22, the snuffing cover 13 is opened by rotating the cover 13 clockwise with the thumb 22 engaged with the finger engaging portion 15 of the cover 13, and the valve opening lever 5 is swung clockwise to open the valve in the nozzle 4 by depressing the finger engaging portion 5*a* of the lever 5 with the thumb 22 as shown in FIG. 3. Thus, the flint element 8 is rubbed with the sparking wheel 10 to provide a spark on the nozzle 4 and the valve of the nozzle 4 is opened to spout fuel gas from the nozzle 4. Since the snuffing cover 13 is opened at this moment, the lighter is lit while the valve opening lever 5 is depressed in the open position.

To extinguish the flame, the thumb 22 is released from the lever 5 to close the valve and the snuffing cover 13 is closed with a finger or the thumb. In order to facilitate the flame extinguishing operation, the cover 13 may be provided with a spring which biases the cover 13 into its closed position.

Figure 10:
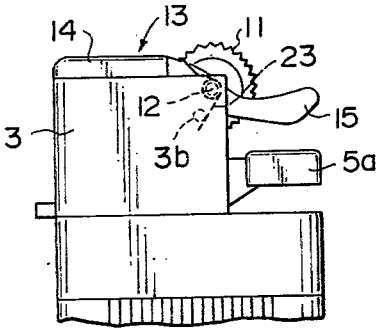
FIG. 10 is a fragmentary side view showing another embodiment of the disposable lighter in accordance with the present invention.
Figure 11:
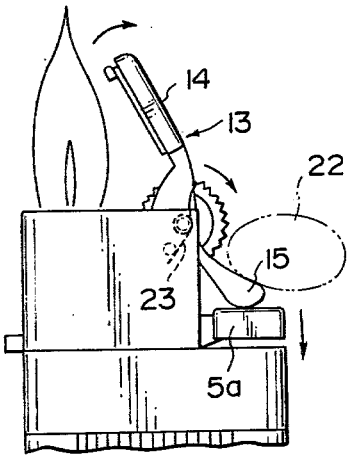
FIG. 11 is a fragmentary side view of the lighter as shown in FIG. 10 in which the snuffing cover is opened and the valve open lever is depressed.

One example of such a variation will be described hereinbelow with reference to FIGS. 10 and 11. In the embodiment shown in FIGS. 10 and 11, a cover biasing spring 23 is provided to bias the cover 13 into its closed position. A pin 3*b* is fixed to the inner face of the wall 3 to hold the spring 23 in the cover biasing position. The spring 23 is held in such a position that one end is engaged with the pin 3*a* and the other end is engaged with the covering portion 14 of the cover 13. In this embodiment, since the cover 13 is always biased into its closed position, the snap-in projection 18 of the cover 13 as shown in FIGS. 2 and 6 to 8 can be eliminated. Further, in this embodiment, as shown in FIGS. 10 and 11, the finger engaging portion 15 of the cover 13 is elongated so that the finger engaging portion 5*a* of the valve opening lever 5 is depressed together with the finger engaging portion 15 of the cover 13. Therefore, in this embodiment, the opening operation of the snuffing cover 13 is securely effected.

I claim:

1. A disposable cigarette gas lighter comprising a plastic fuel reservoir for retaining therein liquified inflammable gas and an operative lighter assembly mounted thereon, said lighter assembly including a flint holding means for holding a flint element, a sparking wheel provided with a pair of knurled wheels secured thereto, a spring element provided in the flint holding means for biasing the flint element onto the sparking wheel, a shaft for rotatably mounting the sparking wheel, a fuel nozzle for connecting the interior of the reservoir with the ambient air, a shut-off valve including means biasing it to a closed position incorporated in the nozzle, a valve opening lever for opening the shut-off valve, and a windbreak wall secured on the reservoir to surround the nozzle, wherein the improvement comprises a snuffing cover and means mounting said snuffing cover for rotational movement independent of said knurled wheels and valve opening lever between a closed position to close an open upper end of said windbreak wall and an open position to open the same, and means for holding the snuffing cover in its closed position, said snuffing cover having a finger engaging portion with which the finger used for rotating said knurled wheels is engaged after it has rotated the knurled wheels to move the snuffing cover from said closed position to said open position overcoming the force of said snuffing cover holding means.

2. A disposable cigarette gas lighter as defined in claim 1 wherein said snuffing cover is provided with a pair of slots through which said knurled wheels are exposed to be rotated with a finger.

3. A disposable cigarette gas lighter as defined in claim 1 wherein said means for holding the snuffing cover in its closed position is a snap-in projection formed integrally on a part of the snuffing cover and an engaging groove formed on a part of the windbreak wall.

4. A disposable cigarette gas lighter as defined in claim 1 wherein said means for holding the snuffing cover in its closed position is a spring which biases the snuffing cover into its closed position.

5. A disposable cigarette gas lighter as defined in claim 1 wherein said snuffing cover is rotatably mounted on said shaft for rotatably mounting the sparking wheel.

6. A disposable cigarette gas lighter as defined in claim 5 wherein said snuffing cover comprises a covering portion to cover the open upper end of the windbreak wall, a finger engaging portion which is engaged with the finger used for rotating the knurled wheels, a pair of slots through which said knurled wheels are exposed, and a pair of lugs having bearing slots to be rotatably engaged with said shaft.

* * * * *